US006480173B1

(12) United States Patent
Marino

(10) Patent No.: US 6,480,173 B1
(45) Date of Patent: Nov. 12, 2002

(54) QUADRIFILAR HELIX FEED NETWORK

(75) Inventor: Ronald A. Marino, Flushing, MI (US)

(73) Assignee: RecepTec LLC, Holly, MI (US)

( * ) Notice: Subject to any disclaimer, the term of this patent is extended or adjusted under 35 U.S.C. 154(b) by 0 days.

(21) Appl. No.: 09/724,234

(22) Filed: Nov. 28, 2000

(51) Int. Cl.[7] ..... H01Q 1/36
(52) U.S. Cl. ..... 343/895; 343/778
(58) Field of Search ..... 3434/895, 702, 3434/730, 778, 740, 905; H01Q 1/36

(56) References Cited

U.S. PATENT DOCUMENTS

| | | | | |
|---|---|---|---|---|
| 3,987,458 A | * | 10/1976 | Reggia et al. | 343/846 |
| 6,034,650 A | * | 3/2000 | Kuramoto | 343/895 |
| 6,072,441 A | * | 6/2000 | Tanabe | 343/895 |
| 6,094,178 A | * | 7/2000 | Sanford | 343/895 |
| 6,204,827 B1 | * | 3/2001 | Endo et al. | 343/895 |
| 6,229,498 B1 | * | 5/2001 | Matsuyoshi et al. | 343/895 |

OTHER PUBLICATIONS

"Fixed and Mobile Terminal Antennas", A. Kumar, Artech House, 1991, Chapter 5, pp. 163–174.
"Modified Quadrifilar Helix Antennas for Mobile Satellite Communication", 1998 IEEE AP–S Conference on Antennas and Propagation for Wireless Communications, pp. 141–144.
"A Printed Circuit Balun for Use with Spiral Antennas", R. Bawer and J. J. Wolfe, IRE Transactions on Microwave Theory and Techniques, May 1960, pp. 319–325.

* cited by examiner

*Primary Examiner*—Don Wong
*Assistant Examiner*—Trinh Vo Dinh
(74) *Attorney, Agent, or Firm*—Ware, Fressola, Van Der Sluys & Adolphson LLP

(57) ABSTRACT

A radio antenna system having a quadrifilar antenna having four helical arms and a method of feeding the arms. The antenna system comprises a first balun having a feed line and two feed points with 180° phase differential therebetween for feeding one opposite arm pair, and a second balun having a feed line and two feed points with 180° phase differential therebetween for feeding the other opposite arm pair. The two feed lines are combined in a single combiner, which provides a 90° phase differential between the feed lines.

3 Claims, 5 Drawing Sheets

QUADRIFILAR HELIX FEED NETWORK

FIELD OF THE INVENTION

The present invention relates generally to an antenna system with broad-band operating characteristics and, more particularly, to a quadrifilar helix antenna for use in the Sirius Satellite Radio (2320–2332.5 MHz), XM Satellite Radio (2332.5–2345 MHz) and the like.

BACKGROUND OF THE INVENTION

An active quadrifilar helix (QFH) antenna is currently used in mobile satellite communication. QFH antennas are known in the art. As disclosed in "Fixed and Mobile Terminal Antennas"(by A. Kumar, Artech House, 1991, Chapter 5, pp.163–174), a QFH antenna comprises four helices, circumferentially and equally spaced on a dielectric cylinder or some dielectric disk support and fed with equal amplitude signals driven in phase quadrature. As shown in FIG. 1, the antenna requires a phasing network or balun, which connects to the four helices for providing signals having a 0°, 90°, 180° and 270° phase relationship to the helices and for matching the impedance of the helices to a coaxial feed line. The quadrifilar helix can be fed from the bottom, as shown in FIG. 1. Currently, the phasing network for feeding the helices incorporates multiple 90° hybrids, as shown in "Modified Quadrifilar Helix Antennas for Mobile Satellite Communication" (1998 IEEE AP-S Conference on Antennas and Propagation for Wireless Communications, pp.141–144). A number of such hybrids are commercially available in both discrete form and single chip form. In the single chip form, there are four outputs extended from the chip for providing electrical connections to the helices. The insertion loss of the feed circuit incorporating the single chip is typically in the 0.75 to 1.25 dB range. Similar insertion loss is also found on the discrete hybrids. This level of insertion loss is unacceptable for use in either the Sirius or the XM systems.

Alternatively, the quadrifilar helix can be constructed as two orthogonally arranged bifilar helical antennae to be fed from the top, as shown in FIG. 2 and disclosed in "Fixed and Mobile Terminal Antennas"(by A. Kumar, Artech House, 1991, Chapter 5, p.168). As shown, the helix is fed from the top by running two coaxial cables to the lower end of the helices so that the bifilar antennae can be phased by a single hybrid. The high insertion loss, in this case, is mostly due to the length of the coaxial cables. Such an quadrifilar antenna is also unacceptable for use in the Sirius and XM systems.

It is, therefore, desirable to provide a phasing network, wherein the insertion loss can be reduced so that they can be used with the Sirius, XM and similar systems.

SUMMARY OF THE INVENTION

It is an object of the present invention to provide a radio antenna operable in the frequency range of Sirius and XM systems and the like, wherein in the insertion loss is greatly reduced.

It is another object of the present invention to provide a radio antenna system based on the known quadrifilar helix which is fed from baluns, wherein the baluns are simple and costeffective.

Thus, the first aspect of the present invention is a method of feeding a quadrifilar antenna having four helical arms circumferentially and equally spaced on a dielectric cylinder, wherein the arms have electrically connected first ends and separated second ends located on different quadrants of a circle. The method comprises the steps of:

providing a first balun having two feed points located on the opposite quadrants of the circle for feeding two of the helical arms, and providing a second balun having two feed points located on the different opposite quadrants of the circle for feeding the other two of the helical arms.

Preferably, the first balun comprises:

a dielectric substrate having a first side and an opposing second side;

two electrically conductive planes located on the first side for separately providing the two feed points of the first balun; and a first feed line located on the second side for electromagnetically coupling the electrically conductive planes of the first balun for providing a 180° phase differential between the two feed points of the first balun, and the second balun comprises:

a dielectric substrate having a first side and an opposing second side;

two electrically conductive planes located on the first side for separately providing the two feed points of the second balun; and a second feed line located on the second side for electromagnetically coupling the electrically conductive planes of the second balun for providing a 180° phase differential between the two feed points of the second balun.

Preferably, the method also comprising the step of combining the first and second feed lines at a common feeding point on a combiner, wherein the combiner has means for providing a 90° phase differential between the first and second feed lines.

The second aspect of the present invention is a radio antenna system based on a quadrifilar antenna having four helical arms circumferentially and equally spaced on a dielectric cylinder, wherein the arms have electrically connected first ends and separated second ends located on different quadrants of a circle. The antenna system comprises:

a first balun having two feed points located on opposite quadrants of the circle for feeding two of the helical arms, and a second balun, orthogonally arranged relative to the first balun, wherein the second balun has two feed points located on different opposite quadrants of the circle for feeding the other two of the helical arms.

Preferably, the first balun comprises:

a dielectric substrate having a first side and an opposing second side;

two electrically conductive planes located on the first side for separately providing the two feed points of the first balun; and a first feed line located on the second side for electromagnetically coupling the electrically conductive planes of the first balun for providing a 180° phase differential between the two feed points of the first balun, and the second balun comprises:

a dielectric substrate having a first side and an opposing second side;

two electrically conductive planes located on the first side for separately providing the two feed points of the second balun; and a second feed line located on the second side for electromagnetically coupling the electrically conductive planes of the second balun for providing a 180° phase differential between the two feed points of the second balun.

Preferably, the antenna system also comprises a single combiner for electrically connecting the first feed line and the second feed line at a common feed point, wherein the single combiner has means for providing a 90° phase differential between the first and second feed lines.

The present invention will become apparent upon reading the description taken in conjunction with FIGS. 3 to 6*b*.

DETAILED DESCRIPTION OF THE INVENTION

Figure 1:
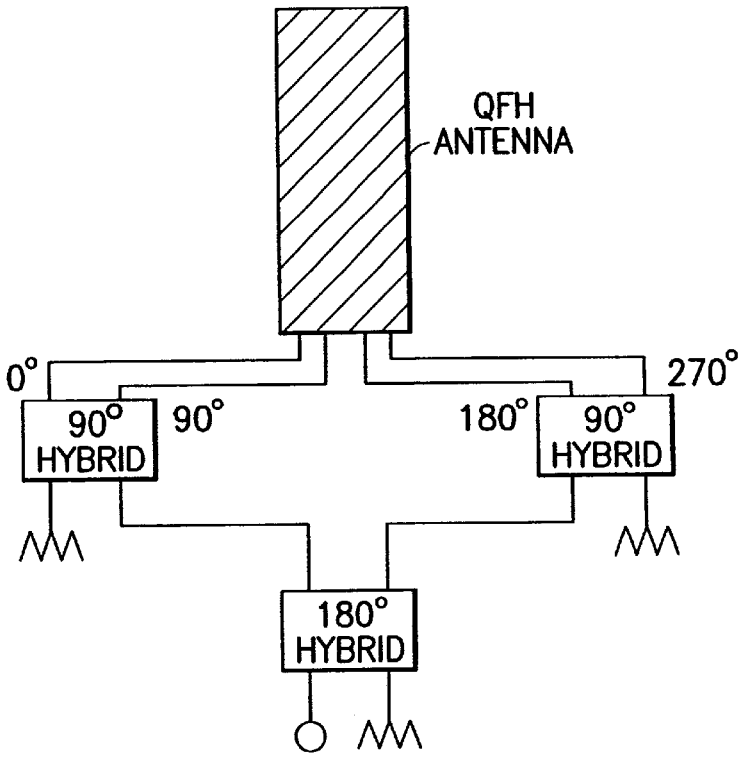
FIG.1 (PRIOR ART)
FIG. 1 is a diagrammatic representation illustrating a prior art quadrifilar antenna system.
Figure 2:
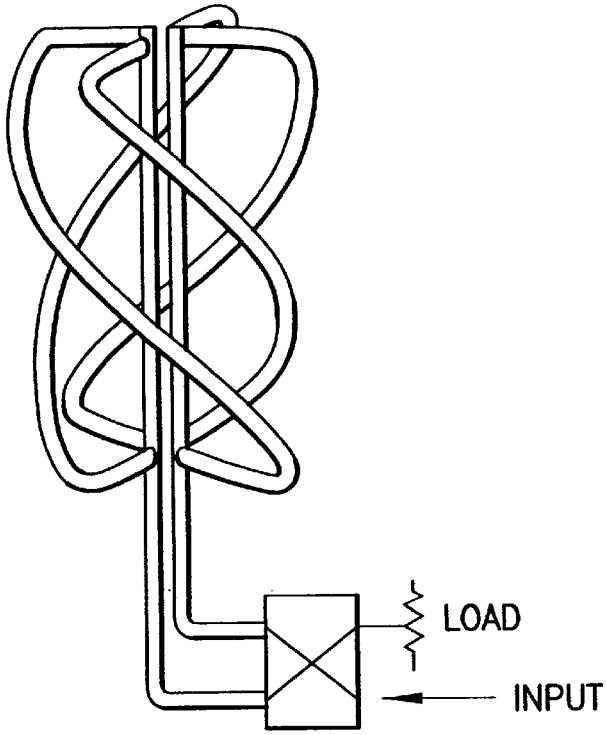
FIG.2 (PRIOR ART)
FIG. 2 is a diagrammatic representation illustrating another prior art quadrifilar antenna system.
Figure 3:
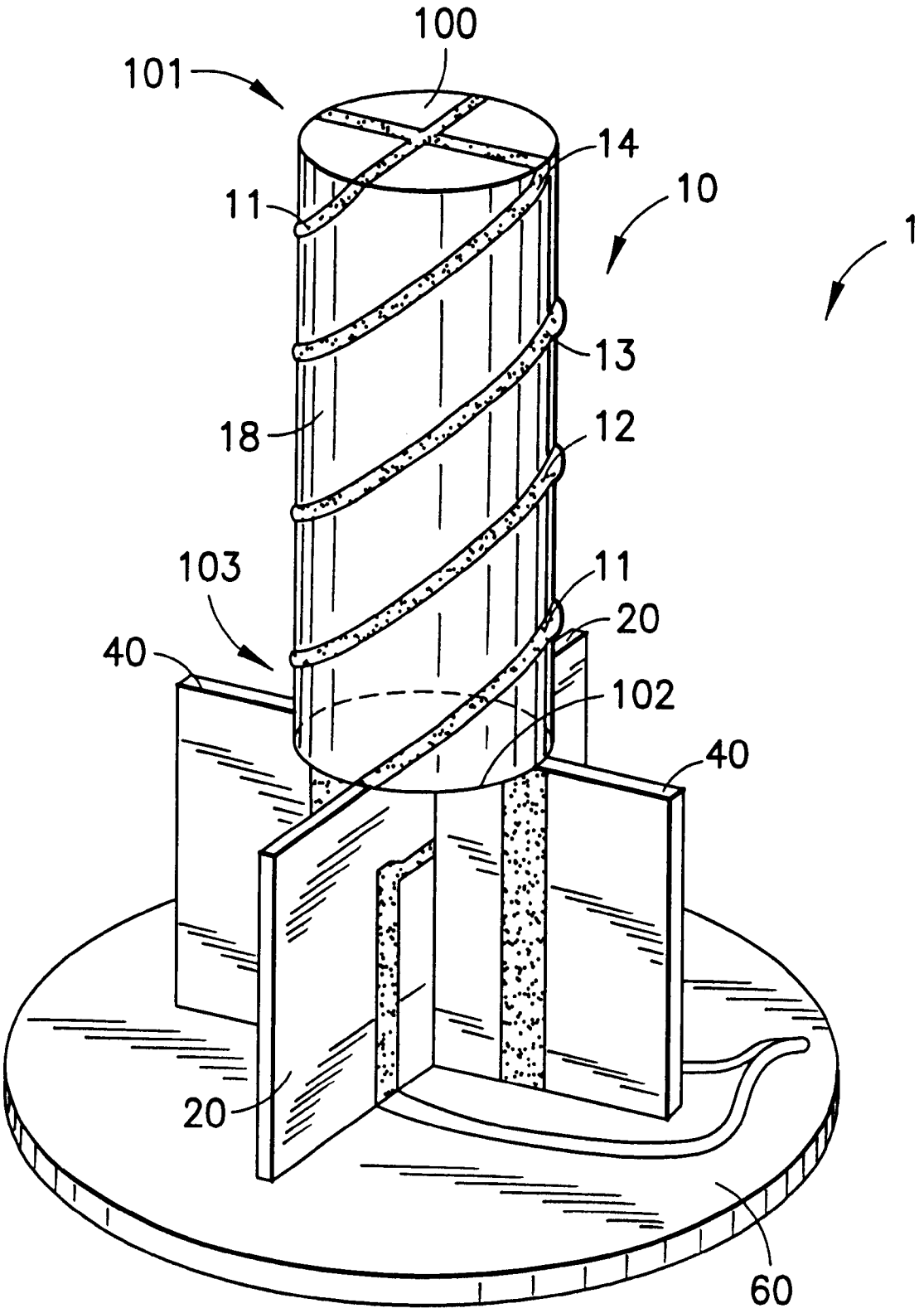
FIG. 3 is a perspective view illustrating the radio antenna system, according to the present invention.

The preferred embodiment of the radio antenna system 1 of the present invention is shown in FIG. 3. The antenna system 1 includes a quadrifilar helix antenna 10, a first balun 20, a second balun 40 and a combiner board 60. Quadrifilar helix antennae are known in the art and, therefore, they are not part of the present invention. As shown in FIG. 3, the quadrifilar antenna 10 has four helical arms 11, 12, 13, 14 circumferentially and equally spaced on a dielectric cylinder 18. The arms 11, 12, 13, 14 are electrically connected at a common point 100 at the first ends 101 of the arms. The second ends 103 of the arms are separately located at different quadrants of a circle 102. The first balun 20 and the second balun 40 are orthogonally arranged under the circle 102 for feeding the quadrifilar antenna 10 at the second ends of the helices with signals with equal amplitudes but different phases. In particular, arms 11 and 13 are fed by the first balun 20 and arms 12 and 14 are fed by the second balun 40.

Figure 4A:
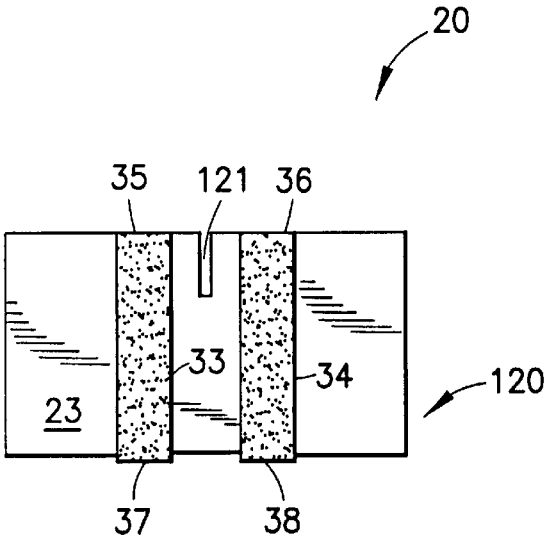
FIG. 4*a* is a diagrammatic representation illustrating the first side of the first balun.
Figure 4B:
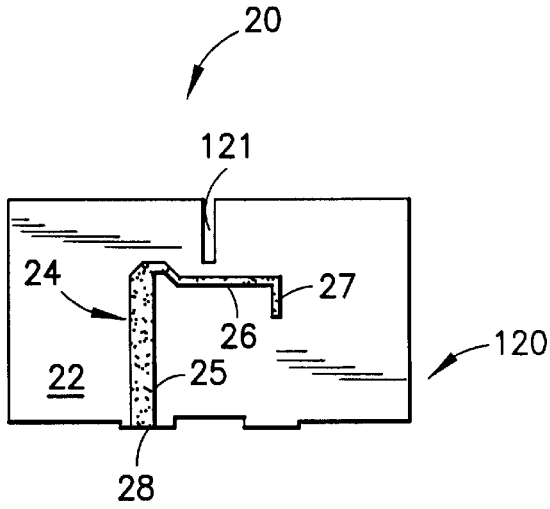
FIG. 4*b* is a diagrammatic representation illustrating the second side of the first balun.

As shown in FIGS. 4*a* and 4*b*, the first balun 20 is printed on a dielectric substrate 120 which has a first side 22 and an opposing second side 23. The substrate 120 has a slot 121 to allow the second balun 40 to be arranged orthogonally to the first balun 20. As shown in FIG. 4*a*, the first balun 20 has two electrically conductive planes 33, 34 separately located on different sides of the slot 121. The conductive plane 33 has an upper tip 35 and a lower tip 37. The conductive plane 34 has an upper tip 36 and a lower tip 38. The upper tips 35, 36 of the conductive planes 33, 34 are electrically connected to opposing arms 11, 13 of the quadrifilar antenna 10 for feeding. The opposing arms 11, 13 are fed from the first balun 20 with signals having a 180° phase differential. As shown in FIG. 4*b*, a feed line 24 is located on the first side 22 having an inner section 25 substantially aligned with the conductive plane 34. The feed line 24 has an outer section 27, which is substantially aligned with the conductive plane 33. The feed line 24 also has an extended section 26 for connecting the outer section 27 to the inner section 25 so that the signals fed to the opposing arms 11 and 13 have a 180° phase differential when the conductive planes 33 and 34 are electromagnetically coupled by the feed line 24. The feed line 24 has a terminal end 28.

Figure 5A:
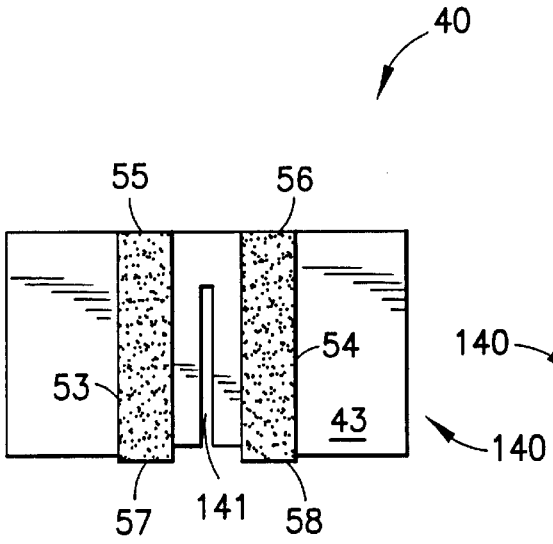
FIG. 5*a* is a diagrammatic representation illustrating the first side of the second balun.
Figure 5B:
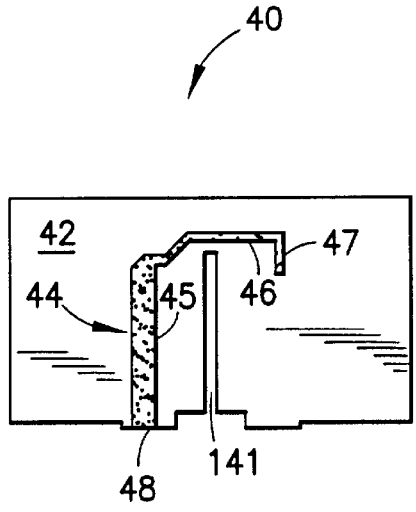
FIG. 5*b* is a diagrammatic representation illustrating the second side of the second balun.

Similarly, the second balun 40 is printed on a dielectric substrate 140, which has a first side 42 and an opposing second side 43, as shown in FIGS. 5*a* and 5*b*. The substrate 140 has a slot 141 complimentary to the slot 121 of the substrate 120 to allow the second balun 40 to be arranged orthogonally to the first balun 20. As shown in FIG. 5*a*, the second balun 40 has two electrically conductive planes 53 and 54 separately located on different sides of the slot 141. The conductive plane 53 has an upper tip 55 and a lower tip 57. The conductive plane 54 has an upper tip 56 and a lower tip 58. The upper tips 55, 56 of the conductive planes 53, 54 are electrically connected to opposing arms 12 and 14 of the quadrifilar antenna 10 for feeding. The opposing arms 12 and 14 are fed from the second balun 40 with signals having a 180° phase differential. As shown in FIG 5*b*, a feed line 44 is located on the first side 42 having an inner section 45 substantially aligned with the conductive plane 54. The feed line 44 has an outer section 47 substantially aligned with the conductive plane 53. The feed line 44 also has an extended section 46 for connecting the inner section 45 to the outer section 47 so that the signals fed to the opposing arms 12 and 14 have a 180° phase differential when the conductive planes 53 and 54 are electromagnetically coupled by the feed line 44. The feed line 44 has a terminal end 48.

Figure 6B:
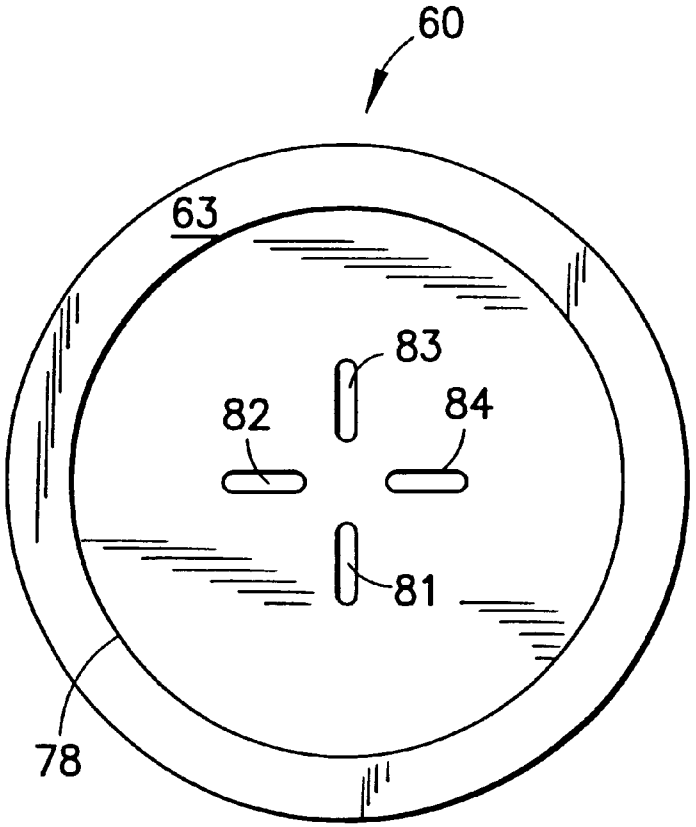
FIG. 6*b* is a diagrammatic representation illustrating the second side of the combiner board.
Figure 6A:
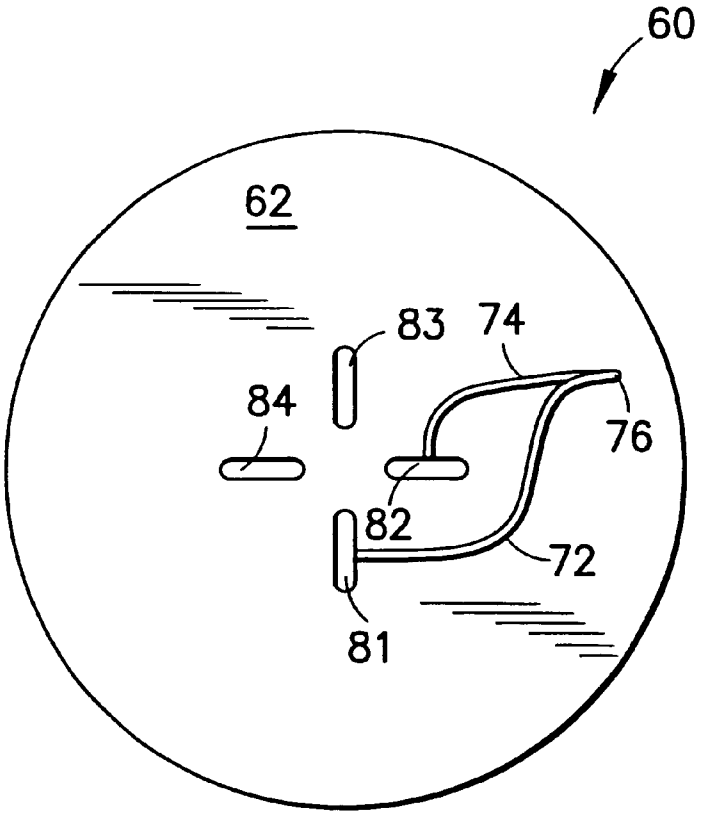
FIG. 6*a* is a diagrammatic representation illustrating the first side of the combiner board.

The feed lines 24 and 44 are electromagnetically combined in such a way that the phase relation between the adjacent arms among arms 11, 12, 13 and 14 is 90° apart. For example, the phase relation in the arms 11, 12, 13 and 14 can be expressed as 0°, 90°, 180° and 270°, or 0°, −90°, −180° and −270°. As shown in FIGS. 6*a* and 6*b*, the combiner board 60 has an upper side 62 and a lower side 63, and four slots 81, 82, 83 and 84 for mounting the first balun 20 and second balun 40. As shown in FIG. 6*a*, a shorter conductive line 74 and a longer conductive line 72 are used to separately provide electrical connections to the inner section 25 of the feed line 24 on the first balun 10 and inner section 45 of the feed line 44 on the second balun 40. The conductive lines 72 and 74 are jointed at a common feed point 76. The conductive line 72, in terms of phase shift, is 90° longer than the conductive line 74. As shown in FIG. 6*b*, the lower side 63 has a common ground plane 78 for electrically connecting the conductive planes 33, 34, 53 and 54 at the lower tips 37, 38, 57 and 58.

Preferably, the first and second baluns 20, 40 are provided as printed circuits on dielectric substrates. As described in conjunction with FIGS. 4*a*–5*b*, the feeding of the quadrifilar antenna 10 from the first and second balun 20, 40 is efficient in that the separation between the baluns 20, 40 and the second ends 103 of the helical arms 11, 12, 13, 14 is short. Thus, the insertion loss is significantly reduced. It has been found that the insertion loss in the antenna as system of the present invention can be reduced to the 0.2–0.4 dB range.

It should be noted that the shape of the conductive planes 33, 34, 53, 54 and the shape of the feed lines 24, 44 can be changed, while the phase relationship in the signals fed to the helical arms can be maintained. Similarly, the arrangement of the conductive lines 72, 74 on the combiner board 60 can also be changed without altering the phase relationship among the helical arms.

Figure 7:
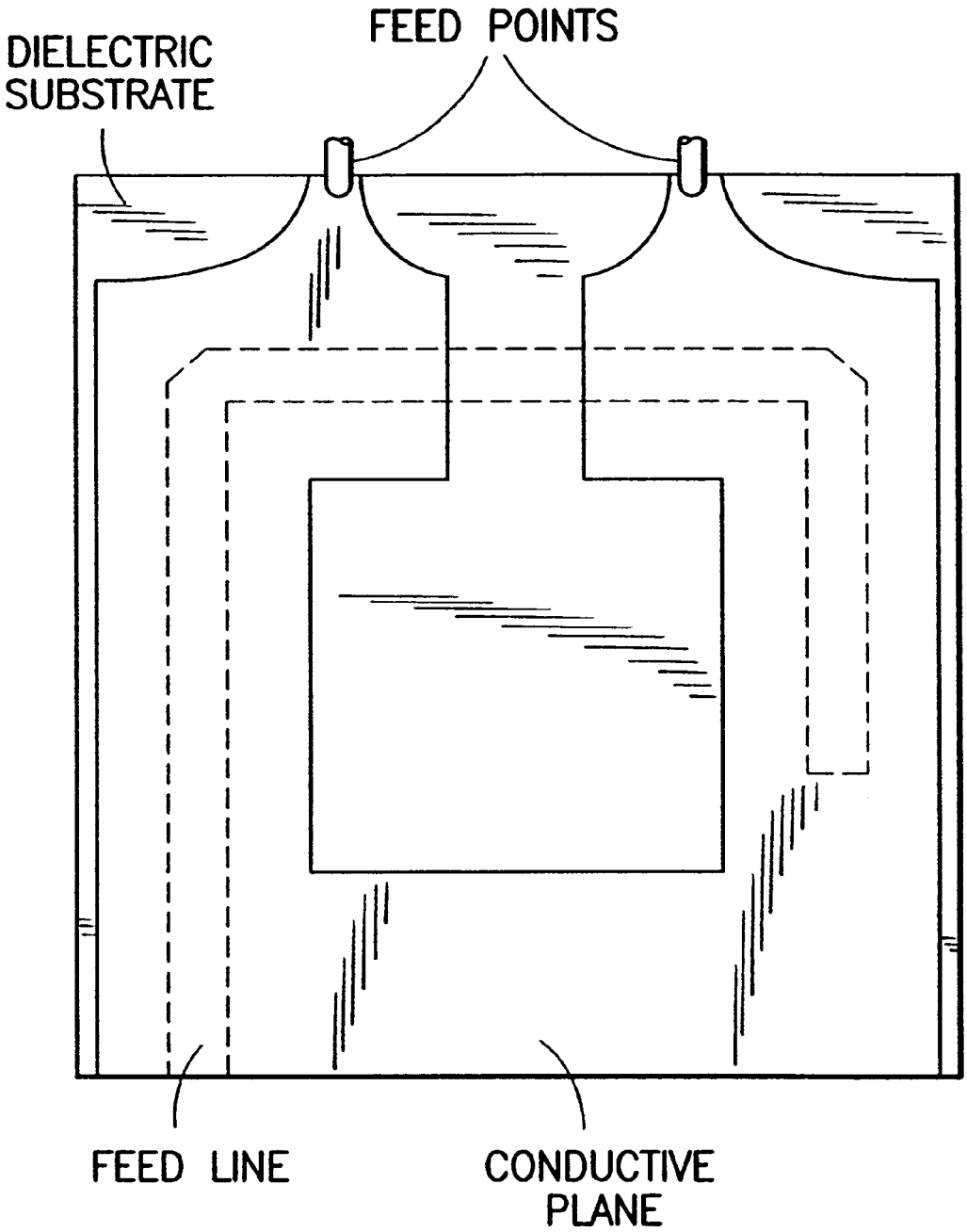
FIG.7 (PRIOR ART)
FIG. 7 is a diagrammatic representation illustrating a prior art balun with two feed points.

It should also be noted that, the quadrifilar antenna 10, as described in conjunction with FIG. 3, is provided on a dielectric cylinder. However, it is not necessary to have such a dielectric cylinder for support. The quadrifilar antenna is well known in the art. Furthermore, a balun provided on a printed circuit is also known in the art. For example, a prior art balun with two feed points, as shown in FIG. 7, is disclosed in "A Printed Circuit Balun for Use with Spiral Antennas" (R. Bawer and J. J. Wolfe, IRE Transactions on Microwave Theory and Techniques, May 1960, pp.319–325). However, the balun, as shown in FIG. 7, cannot be used for the quadrifilar antenna system without modification. The subject matter of the present invention is the arrangement of the baluns in relation to the quadrifilar antenna, the use of a single combiner for providing the necessary phase differential. The subject matter of the present invention is a method of feeding the helical arms of a quadrifilar antenna in a low insertion loss fashion.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A radio antenna system comprising:

a quadrifilar antenna having four helical arms having electrically connected first ends and separated second ends located on different quadrants of a circle;

a first balun having two feed points located on opposite quadrants of the circle for feeding two of the helical arms, and a second balun having two feed points located on different opposite quadrants of the circle for feeding the other two of the helical arms, wherein the first balun comprises:

a first dielectric substrate having a first side and an opposing second side;

two electrically conductive sections located on the first side of the first dielectric substrate for separately providing the two feed points of the first balun; and a first feed line located on the second side of the first dielectric substrate for electromagnetically coupling the electrically conductive planes of the first balun for providing a 180° phase differential between the two feed points of the first balun, and wherein the second balun comprises:

a second dielectric substrate having a first side and an opposing second side;

two electrically conductive planes located on the first side of the second dielectric substrate for separately providing the feed points of the second balun; and a second feed line located on the second side of the second dielectric substrate for electromagnetically coupling the electrically conductive planes of the second balun or providing a 180° phase differential between the two feed points of the second balun, wherein the first substrate has a first slot and the second substrate has a second slot complimentary to the first slot for orthogonally arranging the first balun and the second balun in relation to the circle.

2. The antenna system of claim 1, further comprising a combiner board having a first side and a second side, wherein the first side of the combiner board includes a ground plane for providing a common ground for the conductive planes of both the first and second baluns, and the second side of the combiner board includes a first conductive segment and a second conductive segment longer than the first conductive segment for combining the first and second feed lines and for providing a 90° phase differential between the first and second feed lines.

3. The antenna system of claim 2, wherein the combiner board comprises a printed circuit.

* * * * *

UNITED STATES PATENT AND TRADEMARK OFFICE

CERTIFICATE OF CORRECTION

PATENT NO. : 6,480,173 B1
DATED : November 12, 2002
INVENTOR(S) : Marino

It is certified that error appears in the above-identified patent and that said Letters Patent is hereby corrected as shown below:

Column 4,
Line 64, "as" should be deleted.

Signed and Sealed this

Eleventh Day of March, 2003

JAMES E. ROGAN
*Director of the United States Patent and Trademark Office*